United States Patent [19]

Wheeler

[11] 4,302,936

[45] Dec. 1, 1981

[54] AUTOMOTIVE EXHAUST EMISSION SYSTEM

[75] Inventor: Dean F. Wheeler, Redford Township, Wayne County, Mich.

[73] Assignee: Colt Industries Operating Corp, New York, N.Y.

[21] Appl. No.: 914,492

[22] Filed: Jun. 12, 1978

[51] Int. Cl.[3] ..... F02B 75/10

[52] U.S. Cl. ..... 60/290; 251/322; 251/337

[58] Field of Search ..... 60/290, 284, 289; 251/322, 332, 337, 333

[56] References Cited

U.S. PATENT DOCUMENTS

| | | | |
|---|---|---|---|
| 2,844,323 | 7/1958 | Engstrom | 251/333 |
| 3,520,320 | 7/1970 | Crawford | 60/290 |
| 3,919,843 | 11/1975 | Arnaud | 60/290 |
| 3,992,878 | 11/1976 | Moorman | 60/290 |
| 4,050,249 | 9/1977 | Collins | 60/290 |
| 4,104,880 | 8/1978 | Ito | 60/290 |

*Primary Examiner*—Michael Koczo, Jr.
*Attorney, Agent, or Firm*—Walter Potoroka, Sr.

[57] ABSTRACT

An internal combustion engine having an exhaust system is shown provided with an air pump which is effective for supplying air to the exhaust system to oxidize unburned hydrocarbons within the exhaust gases of the exhaust system; a valve assembly, operatively interposed between the air pump and the exhaust system, is effective, in response to parameters of engine operation, to at times cause a portion or even all of the air supplied by the air pump to be delivered to the atmosphere instead of to the exhaust system.

2 Claims, 8 Drawing Figures

AUTOMOTIVE EXHAUST EMISSION SYSTEM

BACKGROUND OF THE INVENTION

Because of various governmental regulations relating to vehicular engine exhaust emissions, it has been found necessary to supply additional quantities of oxygen, as by atmospheric air, to the engine exhaust gases, prior to such gases being discharged into the atmosphere, in order to further burn (oxidize) such gases and thereby reduce the quantity of unburned hydrocarbons emitted into the atmosphere.

Heretofore, the prior art has proposed the employment of various valving means for directing such additional quantities of air (supplied as by related air pumping means) to the engine exhaust system. However, it has been discovered that such prior art means and devices are not entirely satisfactory in that they are often non-responsive (or responsive but less than desired) to certain conditions or parameters of engine operation thereby resulting, for example, in such additional air being supplied to the exhaust system at times when such additional air is not actually desired.

The invention as herein disclosed and claimed is primarily directed to the solution of such problems of the prior art as well as other related and attendant problems.

SUMMARY OF THE INVENTION

According to the invention, a valve assembly comprises body means comprising an inlet, first and second outlets, first passage means operatively interconnecting said inlet with said first outlet, second passage means operatively interconnecting said inlet with said second outlet, first valving means for at times terminating communication through said first passage means, second valving means for at other times terminating communication through said second passage means, pressure responsive motor means comprising movable pressure responsive wall means operatively connected to said first and second valving means, said movable pressure responsive wall means being exposed at opposite sides thereof to differing pressures wherein the magnitude thereof is related to engine operating conditions and parameters, said wall means being effective to at times cause said first valving means to be opened as to complete communication from said inlet to said first outlet, said wall means being effective to at other times cause said second valving means to be opened as to complete communication from said inlet to said second outlet, and said wall means being effective to at still other times cause both said first and second valving means to be opened as to complete communication from said inlet to both said first and second outlets.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
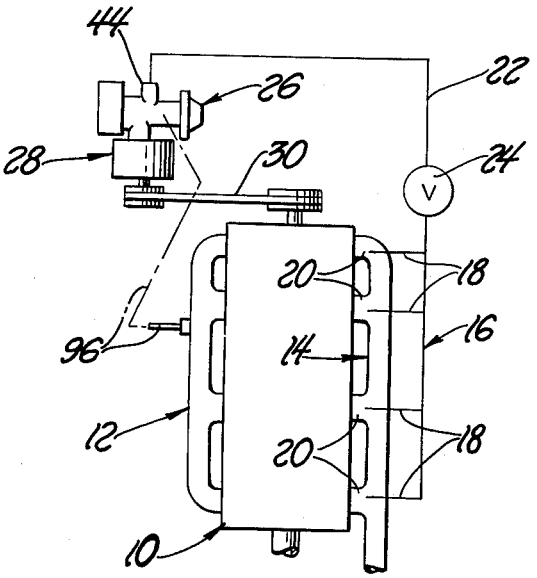
FIG. 1 is a somewhat diagrammatic illustration of an internal combustion engine employing a valving mechanism embodying teachings of the invention.

Referring now in greater detail to the drawings, FIG. 1 illustrates an engine 10 having an intake manifold 12, an exhaust manifold 14 and an air manifold 16 with branch conduits 18 leading to the exhaust manifold 14 as, for example, to branch portions 20 of the exhaust manifold just downstream of the related engine exhaust valves. A conduit 22 leading to air manifold 16 may have a check valve 24 serially connected therewith in order to prevent exhaust back pressure from entering the conduit 22 and back to the valving assembly 26.

A suitable air pump 28 is driven by the engine 10 as through belt drive means 30. In the arrangement illustrated, the valve assembly 26 is physically carried by the pump 28 as to place the outlet of the pump 28 in communication with the inlet of the valve assembly 26. It should be made clear that even though the valve assembly 26 is shown mounted onto the pump assembly 28, the valve assembly 26 may in fact be divorced from the pump 28 and physically situated in any convenient location remote from the pump 28 with related operative connections being made by suitable conduitry. The purpose of the engine driven pump 28 is, of course, to supply air to the exhaust manifold 14 at all of such times as it is desired to have such additional air supplied thereto.

Figure 2:
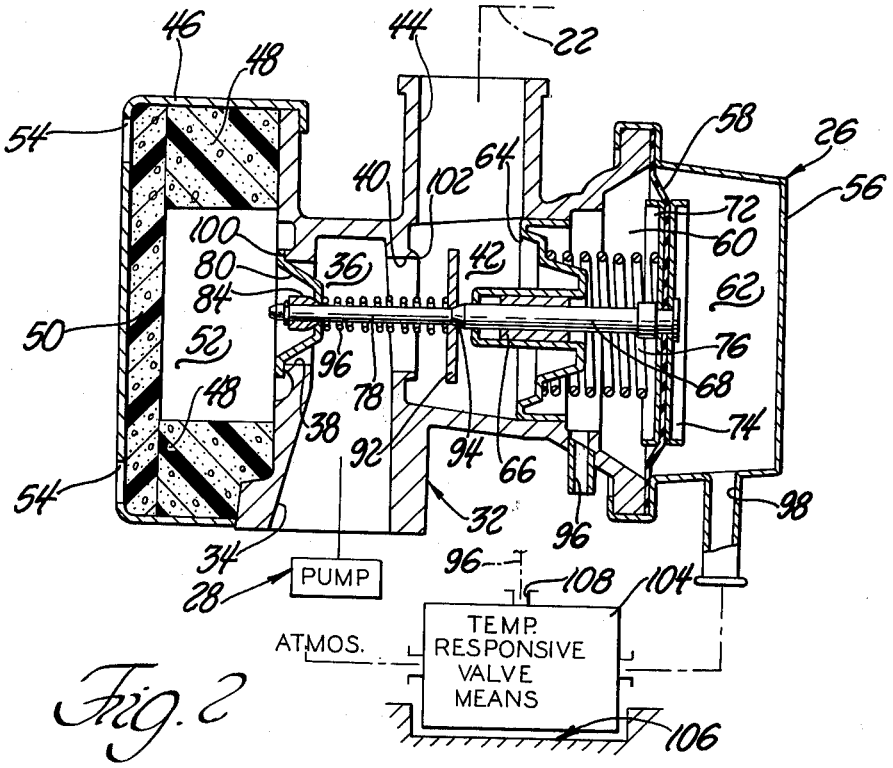
FIG. 2 is a relatively enlarged axial cross-sectional view of the valving mechanism of FIG. 1.

Referring in greater detail to FIG. 2, the valve assembly 26 is illustrated as comprising a main body or housing 32 having an inlet passage or conduit portion 34 communicating with a first chamber-like portion 36 which, in turn, is provided with first and second orifices or passages 38 and 40. Orifice or passage 40, in turn, communicates with a second chamber-like area or portion 42 which communicates with outlet passage or conduit portion 44 communicating, as via conduit means 22, with air manifold 16.

A first cup-like housing portion 46 is suitably secured to the left end (as viewed in FIG. 2) of the housing 32 and contains generally annular porous noise damping material 48 and a disc-like portion 50 of porous noise damping material. The space 52, generally defined by members or means 48 and 50, communicates with the ambient atmosphere as through the porous noise damping material and a plurality of apertures 54 formed in housing portion 46.

A second cup-like housing portion 56, carried as at the right end of housing or body 32, serves to peripherally retain a pressure responsive wall or diaphragm 58 as to define, at opposite sides thereof, respective chamber areas 60 and 62. An internal wall, such as annular member 64, tightly received in body section 32, serves as the opposite wall of chamber 60 and also carries a bushing or bearing member 66 which, in turn, closely slidably receives a stem 68 which, at its right end, is operatively connected and secured to diaphragm 58 as having its head-like portion 70 engaged against oppositely disposed diaphragm backing plates 72 and 74 which contain the central portion of diaphragm 58 between them. Wall 64 also serves as a fixed seat for a spring 76 which has its opposite end operatively engaged with diaphragm 58 as through diaphragm plate 72.

Figure 3:
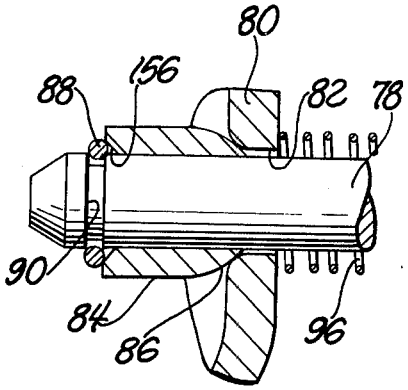
FIG. 3 is a still further relatively enlarged fragmentary portion of the structure of FIG. 2.

Stem 68 comprises an extension 78 of reduced cross-sectional diameter which, at or near its left-most end, carries a bowl-like valve member 80 which has an inner diameter or passageway 82 somewhat larger than the diameter of extension 78 as to permit some significant angular movement of valve 80 relative to the axis of extension 78. As also shown in FIG. 3, a tubular retainer 84, provided with a generally spherical seat portion 86, is slidably received by stem extension 78 and axially retained thereon as by a snap ring 88 engaged in an annular groove 90 formed near the end of stem extension 78. A second annular valve member 92, also somewhat loosely received about stem extension 78, has an inner aperture defined as by an inner annular chamfered portion, permitting such valve member 92 to be generally seatable against a diametral transitional portion 94 of stem 68. A coiled compression spring 96, situated generally about stem extension 78, effectively urges valve member 80 to the left, against seat 86 of stop 84, and urges valve member 92 to the right against seating or stop means 94.

As generally depicted in FIGS. 1 and 2, chamber 60 is placed in communication with a source of engine developed or intake manifold vacuum as by conduit means 96 while chamber 62 is placed in communication as with a source of reference pressure which, in the preferred embodiment, would be atmospheric pressure as from ambient air via conduit or passage means 98.

OPERATION OF INVENTION

Generally, air supplied by pump 28 flows into intake or inlet passage 38 into chamber 36 and from there flows through passage means 40 into chamber area 42 and out through outlet passage means 44 and into passage or conduit means 22 from where the air flows through check valve 24 into air manifold 16 and through branch passages 18 into the engine exhaust system and manifold 14.

During certain conditions of engine operation, the air pump 28 may actually supply more air than is required or desired to be delivered to the engine exhaust system. During such conditions the pressure of the air consequently increases as in inlet conduit 34 and chamber area 36. The increasing air pressure acts against the effective area of valve member 80 and when the resulting force thereof becomes sufficient, due to a still increasing magnitude of the air pressure, valve member 80 is moved to the left, against the resilient resistance and preload of spring 76, and away from its annular valve seat 100 thereby allowing some of the pumped air to pass through passageway 38 into chamber 52 through noise muffling means 48 and 50 and to the atmosphere via passages 54. Such an automatic venting of some of the pumped air may well be required as during relatively high speed engine operation wherein, because of the direct connection between the air pump 28 and the engine, the pump provides a mass rate of pumped air flow in excess of what is required at the engine exhaust system. In such a situation, when engine speed again is sufficiently decreased, the pump air pressure in chamber area 36 would likewise decrease permitting spring 76 to move stem 68 and valve 80 to the right causing valve 80 to seat against its cooperating annular seat 100 and thereby terminate further flow through passage 38.

Further, additional pneumatic signal means effect the operation of the valve means 26. That is, chamber 60 is in communication with a source of engine manifold (intake) vacuum, as by conduit means 96. Consequently, the left side of diaphragm means 58 is exposed to a variable relatively low pressure while the right side of diaphragm means 58 is exposed to a relatively constant relatively higher pressure (ambient atmosphere). Therefore, when the magnitude of the manifold vacuum becomes sufficiently great, as for example during periods of engine deceleration, the resulting force, created by the then differential in pressures across diaphragm means 58, causes diaphragm means 58 to move against the preload and spring rate of spring 76 sufficiently to result in stem 68 moving valve 92 closed against its cooperating annular seat 102 and, at the same time, moving valve 80 away from its cooperating annular seat 100. As a result of this further pumped air flow from chamber 36 through passage means 40 and to the exhaust system 14 is prevented and, instead, all of such pumped air flow is directed to the ambient atmosphere as through opened passageway 38, chamber 52, muffling means 48, 50 and apertures 54. When the magnitude of the manifold vacuum sufficiently decreases the various elements will again return to the respective positions depicted in FIG. 2.

FIG. 2 also illustrates another contemplated arrangement. That is, in some arrangements it may be desired to at times permit communication and at other times terminate such communication as between chamber 62 and the ambient atmosphere. In such situations, conduit means 98 would be operatively connected as to related suitable pneumatic switch means 104 which, in turn, would communicate with ambient atmosphere. Preferably, such switch means would be temperature responsive and it is contemplated that such would be responsive to, for example, either engine temperature or the temperature in the engine air intake air cleaner assembly, either structure being schematically depicted at 106. In this contemplated arrangement, the temperature switch means 104 would be effective when below a sensed temperature (of the air cleaner interior or engine) to complete communication as between ambient atmosphere and chamber 62. However, when the magnitude of such sensed temperature exceeds a preselected magnitude, the valving means 104 would close thereby terminating the communication between ambient atmosphere and passage 98 and chamber 62. It is also contemplated that the valving means 104 may be of the type which not only would terminate such communication as between ambient atmosphere and chamber 62 but would also, at such time of termination, complete communication as between a source of engine or manifold vacuum and chamber 62 thereby effectively exposing both sides of diaphragm 58 to manifold vacuum. This could be achieved as by conduit means, diagrammatically illustrated at 108 which would communicate as with intake manifold 12 as through a connection with conduit 96. In such a contemplated arrangement, communication as between manifold 12 and chamber 62 would be precluded until the valving means 104 sensed a preselected temperature parameter. Obviously, when both chambers 60 and 62 are at the same pressure, the elements will assume the respective positions depicted in FIG. 2 and still, upon increase of pumped air pressure within chamber 36, as previously described, valve 80 may be partially unseated to vent some of the excess air to the atmosphere.

STRUCTURE OF FIG. 4

Figure 4:
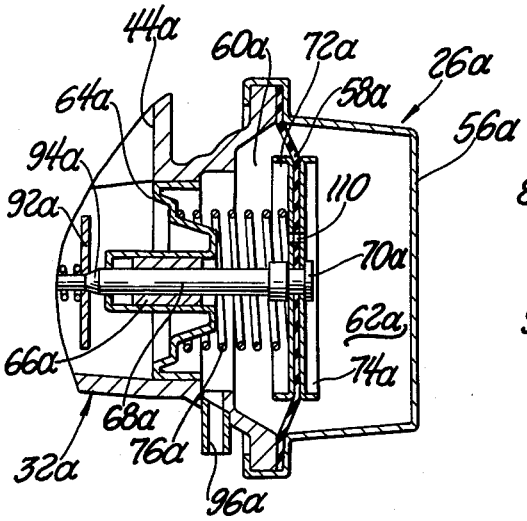
FIG. 4 is a view similar to a fragmentary portion of the structure of FIG. 2 and illustrating a modification thereof.

FIG. 4 illustrates a further embodiment or modification of the invention. Except as otherwise noted, the structure of FIG. 4 is like that of FIG. 2 and all elements shown in FIG. 4 which are like or similar to those of FIG. 2 are identified with like reference numbers provided with a suffix "a".

In the embodiment of FIG. 4, it will be noted that the cup-like housing section or portion 56*a* is shown as not having any vent or passage formed therein as to provide for communication as between chamber 62*a* and, for example, ambient atmosphere. It should be made clear that the practice of the invention, as generally depicted in FIG. 4, is not limited to the configuration of member 56*a* depicted therein. That is, it is conceivable that a housing section such as 56 in FIG. 2 could be employed which would be provided with passage means such as at 98. In such event, the passage means, as 98, would merely be capped or otherwise effectively closed.

The principal difference as between the embodiments of FIGS. 2 and 4 resides in the provision, in FIG. 4, of a calibrated bleed-like passage means formed through the pressure responsive wall means 58*a*. Such a calibrated passage means may be formed as at 110 as to functionally complete controlled communication as between chambers 60*a* and 62*a*.

Under certain engine operating conditions only a momentary interruption of pumped air flow to the engine exhaust system 14 is desired. These engine operating conditions may be the type where there is a sudden increase in the magnitude of engine intake manifold vacuum. This could occur, for example, when the engine throttle is suddenly closed but permitted to remain closed only for a relatively short period of time.

Because of calibrated orifice means 110, during steady state engine operation, the pressure within chamber 60*a* will be equal to the pressure within chamber 62*a*. However, when there is a sudden increase in the magnitude of engine or manifold vacuum, the pressure in conduit 96*a* and chamber 60*a* is likewise suddenly reduced. Such a sudden change in pressure in chamber 60*a* is not immediately totally communicated to chamber 62*a* because of the restrictive effect of calibrated restriction means 110. Therefore, when the pressure is suddenly decreased in chamber 60*a*, the pressure in chamber 62*a* tends to stay at the magnitude which it was immediately prior to the time that the pressure was suddenly decreased in chamber 60*a*. Therefore, a pressure differential of sufficient magnitude is suddenly created across wall or diaphragm means 58*a* causing such diaphragm means 58*a* and stem 68*a* to move to the left, against the preload and spring rate of spring 76*a*, causing the valve 80 (shown in FIG. 2) to be opened and valve 94*a* to be closed thereby interrupting pumped air flow through passage means 40 (shown in FIG. 2) and outlet passage 44*a* to engine exhaust system 14.

It is assumed that the suddenly decreased magnitude of pressure continues to exist in chamber 60*a*, it can be seen that since chamber 62*a* is, in effect, a closed or dead chamber, the relatively greater pressure in chamber 62*a* would slowly bleed into chamber 60*a* through bleed restriction 110 and when the pressure in chamber 62*a* sufficiently reduces, by such bleed effect, the spring 76*a* becomes effective for moving the elements back to the positions depicted in FIG. 4 wherein the bypassing of pumped air to the ambient atmosphere is again terminated and the communication of pumped air to the exhaust system means 14 is again re-established.

STRUCTURE OF FIG. 5

Figure 5:
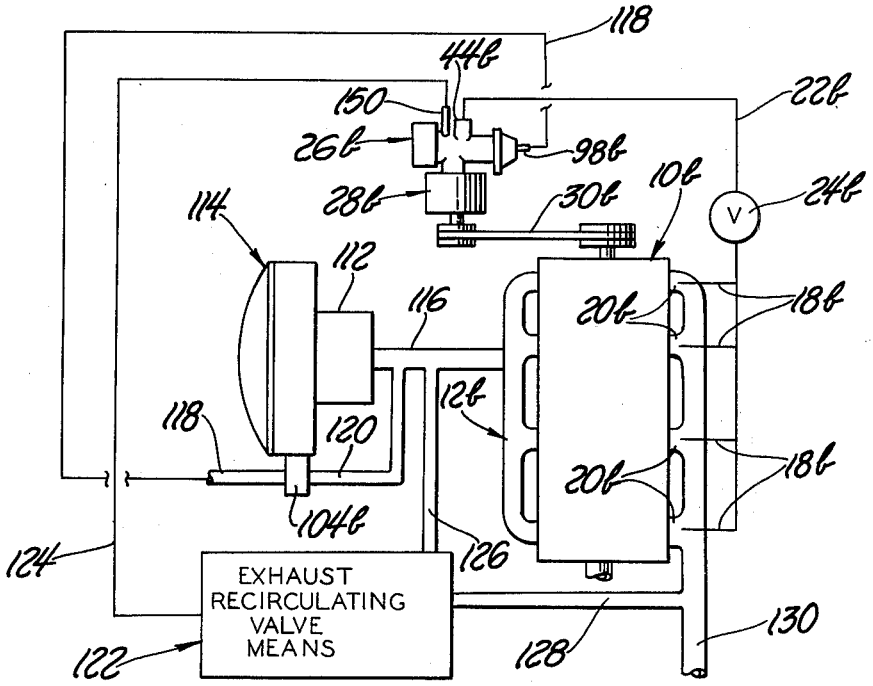
FIG. 5 is a somewhat diagrammatic illustration of an internal combustion engine employing, in a somewhat different overall arrangement, a valving mechanism embodying teachings of the invention.

FIG. 5 is a somewhat diagrammatic illustration of an internal combustion engine employing, in a somewhat different overall arrangement, a valving mechanism embodying teachings of the invention. Those elements of FIG. 5 which are like or similar to those of FIG. 1 are identified with like reference numbers provided with a suffix "b". FIG. 5 also diagrammatically illustrates a carburetor 112, provided as with an inlet air cleaner assembly 114, with the carburetor 112 being operatively connected as by conduit or passage means (downstream of the associated throttle valve not shown) 116 with the engine intake or inlet manifold. The purpose of showing such a conduit 116 is primarily to visually convey a source of engine or manifold vacuum. A pneumatic switch 104*b* is shown operatively associated with air cleaner assembly 114 and, at one side, operatively connected to valving means 26*b* via conduit means 118 and, at an other side, operatively connected to a source of engine or manifold vacuum as by conduit means 120. The overall arrangement may also be provided with suitable exhaust gas recirculating valve means 122 which, if employed, would be operatively connected, via conduit means 124, to valving means 26*b*, and via conduit means 126 and 128 to a source of manifold vacuum (as at a point downsteam of the carburetor 112) and the exhaust conduit portion 130, respectively.

Figure 6:
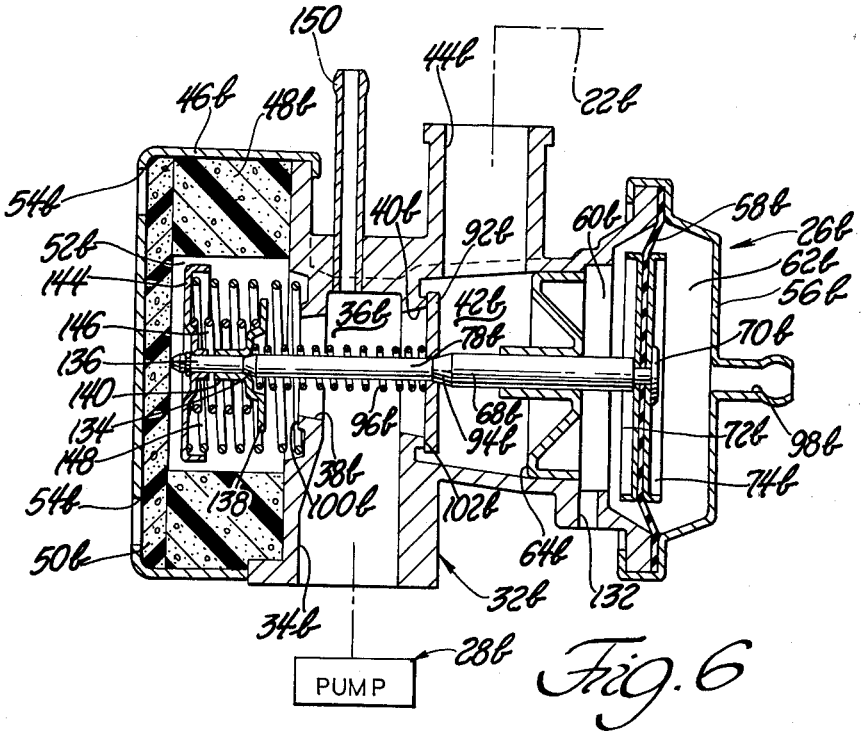
FIG. 6 is a relatively enlarged axial cross-sectional view of the valving mechanism of FIG. 5.

In FIG. 6, all elements which are like or similar to those of FIG. 2 are identified with like reference numbers provided with a suffix "b". Referring in greater detail to FIG. 6, the stem extension 78*b* is preferably provided as with a second transitional portion 134 leading to a still further extension 136 of still further reduced diameter which slidably receives an annular valve 138 effective, for at times, engaging annular seat 100*b* in order to terminate flow through aperture or passage means 38*b* and thereby terminate the bypassing or venting of pumped air to the ambient atmosphere. As depicted in both FIGS. 6 and 7, preferably, valve 138 has a generally longitudinally extending tubular stem portion 140 which is normally held axially away from a juxtaposed tubular portion 142 of an annular spring seat member 144, slidably received on extension 136, as by an inner coiled compression spring 146 operatively engaging both valve 138 and spring seat member 144. The spring seat 144 may be axially retained on extension 136 as by cooperating groove 90*b* and snap ring 88*b*. A second coiled compression spring 148, situated generally within chamber 52*b*, operatively engages spring seat member 144 and housing section 32*b* and thereby serves to position the various elements as depicted in FIG. 6 with the consequent result that valve 92*b* is closed against its cooperating seat 102*b* thereby preventing the flow of pumped air from inlet 34*b* through passage means 40*b* and out outlet 44*b*.

There are certain circumstances or conditions of engine operation during which it is undesirable to inject or supply additional air to the engine exhaust system 14. One of such conditions is when the engine is started and is at a temperature (relatively cold) less than a preselected engine operating temperature.

Assuming that the engine is thusly cold and assuming that pneumatic temperature responsive switch 104*b* is placed in a position as to sense such engine under-temperature, chamber 62*b* will be (depending on the particular type of switch 104*b* employed) connected to either ambient atmosphere or totally closed to communication with any other pressure source. Consequently, upon starting the engine 10*b*, while it is still under-temperature, passage means 132 will admit ambient atmosphere pressure to chamber 60*b* while chamber 62*b* will be either totally closed or also vented to ambient atmosphere. Therefore, spring 148 will maintain the elements to the left, as viewed in FIG. 6, with valve 92*b* being closed against its seat 102*b* and bypass valve 138 being held away from its seat 100*b* thereby bypassing or venting all of the pumped air, from chamber area 36*b*, to the ambient atmosphere via apertures 54*b*.

When temperature responsive pneumatic switch means 104*b* senses that the engine 10*b* has attained a preselected desired engine operating temperature, switch means 104*b* then completes communication as between a source of engine or manifold vacuum, as through conduit means 120, and conduit portion 98*b* and chamber 62*b*. Because of the atmospheric pressure existing in chamber 60*b*, a pressure differential is then created across wall or diaphragm means 58*b* sufficient to overcome the preload and spring rate of spring 148 thereby causing stem 68*b*, bypass valve 138 and valve 92*b* to move to the right resulting in bypass valve 138 being closed against its cooperating annular seat 100*b* and valve 92*b* being opened from its seat 102*b*. Consequently, when engine 10*b* reaches its preselected engine operating temperature, the bypassing or venting to atmosphere of the pumped air is terminated while the communication of such pumped air to the exhaust system 14*b* is completed through opened passageway 40*b*.

Figure 7:
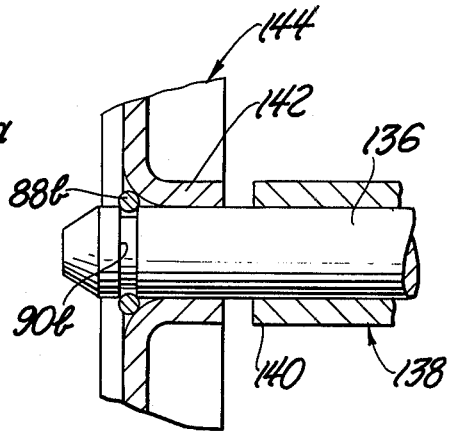
FIG. 7 is a still further relatively enlarged fragmentary portion of the structure of FIG. 6.

However, it should be pointed out that should pump 28*b* provide excessive amounts of air, as described with reference to FIG. 2, the resulting increase in air pressure in chamber area 36*b* will eventually cause bypass valve 138 to move to the left, against the preload and spring force of spring 146 and away from seat 100*b*, to thereby vent or bypass some of the pumped air to atmosphere. The axial space existing as between tubular portions 140 and 142, as best seen in FIG. 7, provide for such movement of valve 138 without the need for attendant movement of stem 68*b*.

FIG. 6, as FIG. 5 also contemplate the possibility of providing conduit or passage means 150 communicating as with chamber area 36*b* and related engine exhaust gas recirculating valving means 122 as through conduit means 124. The gas recirculating valving means 122 would be of the type responsive to the magnitude of pressure signals and conduit 150 would then provide the necessary signals to valving means 122 to indicate when communication between conduits 128 and 126 should be completed and when terminated.

Figure 8:
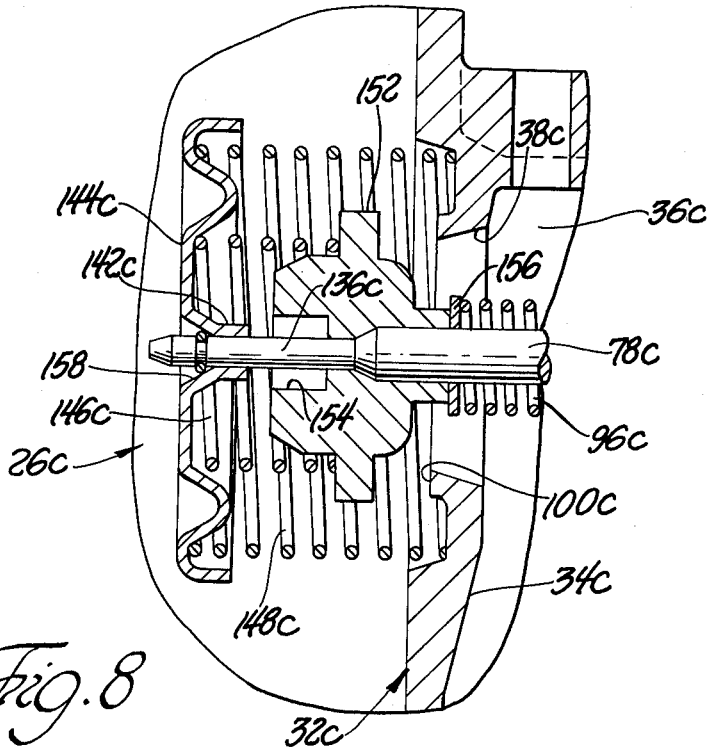
FIG. 8 is a fragmentary cross-sectional view of a valving assembly of the invention illustrating a further modification.

FIG. 8 illustrates another modification of the invention. Except as otherwise noted to the contrary, the structure, fragmentarily illustrated in FIG. 8, may be assumed to be like that disclosed in FIG. 6. In FIG. 8, all elements which are like or similar to those of FIG. 6 are identified with like reference numbers provided with a suffix "c".

Referring in greater detail to FIG. 8, it can be seen that, in effect, the valve 138 of FIG. 6 has been replaced by an annular bypass valve 152 which has a relatively elongated body providing for greater sliding contact with both stem extension portions 78*c* and 136*c* thereby adding to the sliding stability thereof. Further, valve 152 is provided with a counterbore 154 which freely accommodates the juxtaposed tubular stem portion 142*c* of spring seat 144*c* as during such times when valve 152 is moved off its seat 100*c* as by excessive pumped air pressure in chamber area 36*c*. Also, a washer-like bearing member 156 is preferably provided intermediate bypass valve 152 and spring 96*c* as to minimize if not totally eliminate chaffing and wear of the valve 152 by spring 96*c*.

It should be noted that in the preferred form of stop 84 and spring seat 144*c* (respectively shown in FIGS. 3 and 8) that the left-most faces 156 and 158 thereof are inclined as to form a generally conical configuration which sufficiently outwardly respectively encompass the related snap rings 88 and 88*c* to continually urge such rings 88 and 88*c* into seated engagement with their respective cooperating annular grooves on the stem extensions.

Further, as already generally indicated, the generally bowl-like configuration of valve member 80 and the similar outer upstream configuration of valve 152 have been found to provide a greatly improved valve stability during such periods of time as when valves 80 and 152 are fully opened or even partly opened. The prior art has exhibited difficulty to the degree that valve failure sometimes occurs from valve instability and oscillations experienced by such prior art valves especially during partial opening thereof.

Although only a preferred embodiment and selected modifications of the invention have been disclosed and described, it is apparent that other embodiments and modifications of the invention are possible within the scope of the appended claims.

What is claimed is:

1. The combination of an internal combustion engine having intake and exhaust manifolds, an air pump, means operatively connecting said air pump to said engine in order to drive said pump in relation to engine speed, conduit means for delivering air from said pump to said exhaust manifold, first means responsive to the attainment of a predetermined intake manifold vacuum during engine deceleration for preventing delivery of said air through said conduit means to said exhaust manifold during engine deceleration, second means including an opening to atmosphere for at times discharging substantially all of said air delivered by said pump during engine deceleration, said second means also being effective to relieve any excess air pressure generated by said pump at any time by venting said excess air pressure to atmosphere through said opening, and third means responsive to indicia of engine operating temperature for causing said first means to prevent delivery of said air through said conduit means at engine operating temperatures below a predetermined magnitude, said conduit means comprising first and second conduit portions and first passage means interconnecting said first and second conduit portions, said first conduit portion being situated upstream of said first passage means and said second conduit portion, said first means comprising a first valve seat generally circumscribing said first passage means, a first valve member for cooperating with said valve seat for opening and closing said first passage means in order to thereby respectively complete and terminate communication as between said first and second conduit portions, pressure responsive movable diaphragm means, stem means operatively connected to said diaphragm means and operatively carrying said first valve member, said opening comprising second passage means communicating between said first conduit portion and atmosphere, said second means comprising a second valve seat generally circumscribing said second passage means, a second valve member for cooperating with said second valve seat for opening and closing said second passage means in order to thereby respectively complete and terminate communication as between said first conduit portion and atmosphere, said second valve member being operatively carried by said stem means as to be spaced from said first valve member, said second valve member being of cup-like configuration having an axial end wall and an integrally formed circumferentially continuous side wall extending both axially and radially away from said end wall and terminating in a circumferentially continuous radially extending flange portion, said flange portion being effective to seat against said second valve seat when said second valve member is in a position closing said second passage means, said axial end wall comprising aperture means for accommodating the passage therethrough of said stem means, said second valve member being so positioned on said stem means as to have said circumferentially continuous side wall generally received in and confined by said second passage means when said flange portion is seated against said second valve seat, first resilient means operatively connected to said pressure responsive movable diaphragm means and effective for urging said first valve member in a direction away from said first valve seat and effective for urging said second valve member in a direction toward said second valve seat, said aperture means being of a size as to enable said second valve member to move axially relative to said stem and to experience angular deflection relative to the axis of said stem, a retainer member carried by said stem, and second resilient means operatively carried by said stem and operatively engaging and urging said first and second valve members in directions axially along said stem and away from each other whereby said second valve member is resiliently urged into operative engagement with said retainer member, said angular deflection enabled by said aperture means permitting said second valve member to angularly deflect with respect to said stem in order to thereby assure optimum seating engagement as between said flange portion and said second valve seat.

2. The combination according to claim 1 and further comprising means for silencing noise caused by said discharged air.

* * * * *